United States Patent [19]

Spear

[11] 4,238,938

[45] Dec. 16, 1980

[54] WASHING MACHINE AND ACCUMULATOR DEVICE THEREFOR

[75] Inventor: John F. Spear, Dorking, England

[73] Assignee: Universal Towel Company Limited, Sussex, England

[21] Appl. No.: 932,369

[22] Filed: Aug. 9, 1978

[30] Foreign Application Priority Data

Aug. 12, 1977 [GB] United Kingdom ..... 33978/77

[51] Int. Cl.[3] ..... D06F 29/00; D06F 35/00; B65H 17/02; B65H 17/44

[52] U.S. Cl. ..... 68/13 R; 68/177; 226/118; 242/67.1 R; 242/67.5; 242/75.5

[58] Field of Search ..... 226/118, 119, 108, 111; 68/177, 178, 13 R; 242/67.2, 57.1, 75.5, 67.1, 67.5

[56] References Cited

U.S. PATENT DOCUMENTS

| | | | |
|---|---|---|---|
| 2,521,440 | 9/1950 | Bannon | 68/178 |
| 2,698,659 | 1/1955 | Kosek | 226/118 X |
| 2,826,479 | 3/1958 | Cole | 226/118 X |
| 3,078,023 | 2/1963 | Hecker | 226/118 |
| 3,123,268 | 3/1964 | Gagg | 226/118 X |
| 3,402,410 | 9/1968 | Schumm et al. | 68/178 X |
| 3,411,328 | 11/1968 | Fleissner | 68/178 X |
| 3,526,106 | 9/1970 | Kennedy et al. | 68/178 X |
| 4,077,766 | 3/1978 | von der Eltz | 68/178 X |

FOREIGN PATENT DOCUMENTS

| | | | |
|---|---|---|---|
| 627480 | 3/1936 | Fed. Rep. of Germany | 226/118 |

*Primary Examiner*—Stanley N. Gilreath

*Attorney, Agent, or Firm*—Buell, Blenko, Ziesenheim & Beck

[57] ABSTRACT

An accumulator device for a washing machine for washing the towels used in continuous feed towel cabinets, comprises a channel through which the towel is passed. The channel is adapted to allow the towel to be stored therein in concertina or bunched form. Means are provided for preventing the towel from being withdrawn from the device at a speed above a predetermined maximum speed.

13 Claims, 4 Drawing Figures

WASHING MACHINE AND ACCUMULATOR DEVICE THEREFOR

BACKGROUND OF THE INVENTION

1. Field of the Invention

This invention relates to washing machines and to accumulator devices therefor. More particularly but not exclusively, the invention relates to washing machines for the towels used in continuous feed towel cabinets.

2. Prior Art

U.S. Pat. No. 3,526,106 describes a complete machine for laundering the towels used in continuous feed towel cabinets. In the last part of this machine the towel is fed from the drying rolls to a rewind mandrel via an accumulator device. This accumulator device comprises a carriage carrying rollers over which the towel is threaded, the carriage being capable of movement to lengthen the path taken by the towel each time that the rewind mandrel is stopped to remove a roll of towel. The device thereby stores the towel delivered by the drying rolls until the rewind mandrel is restarted. The operational speed of the rewind mandrel is faster than the running speed of the apparatus whereupon the period of time which is lost during completion of the winding of one roll and the start of the winding of the next roll is regained during the winding of that next roll. Moreover, the rewind mandrel is driven by a constant torque motor and thus a slipping clutch is provided to allow for the continuously increasing radius of the roll being wound.

A further aspect of the wind-up operation of the laundering machine described in U.S. Pat. No. 3,526,106 is that it includes means to counteract any misalignment or wandering of the towel being wound which would result in the edges of the wound roll being irregular. Such means are fully described in British patent specification No. 1,136,454 and are operable satisfactorily at a take-up speed which is less than 400 feet/minute.

SUMMARY

According to the invention there is provided an accumulator device for a washing machine for washing the towels used in continuous feed towel cabinets, the device comprising a channel through which the towel is passed, the channel being adapted to allow the towel to be stored therein in concertina or bunched form, drive means for feeding the towel into the channel, and means for preventing the towel from being withdrawn from the device at a speed above a predetermined maximum speed.

Preferably the means for preventing the outfeed speed of the towel from the device rising above a predetermined maximum speed is a mechanism, e.g. a clutch bearing, attached to a roller over which the towel passes, which mechanism precludes the roller from rotating at a speed which will feed the towel from the device at a speed which is greater than the predetermined maximum speed. In one embodiment of the invention the predetermined maximum speed of towel which may be fed out of the device is 400 feet/minute. If desired, limiting means for said roller may allow the predetermined maximum speed to be varied under the control of the operator.

It is also preferred that the storage channel is inclined to the horizontal and preferably inclined upwardly in the direction of movement of the towel with the drive means for feeding the towel into the channel being disposed at the lower end of the channel.

The storage channel may be provided with a well adjacent its outlet end, the towel being fed into the well prior to being discharged from the accumulator device.

Preferably the storage channel has the capacity to store a plurality of towel lengths, for example at least seven towel lengths.

The invention also provides a washing machine for washing the towels used in continuous feed towel cabinets, the washing machine having an accumulator device as described above for the storage of the clean, dry towel prior to it being wound on a rewind mandrel.

DESCRIPTION OF THE PREFERRED EMBODIMENT

This example concerns a new accumulator device for a washing machine of the kind described in U.S. Pat. No. 3,526,106.

Figure 1:
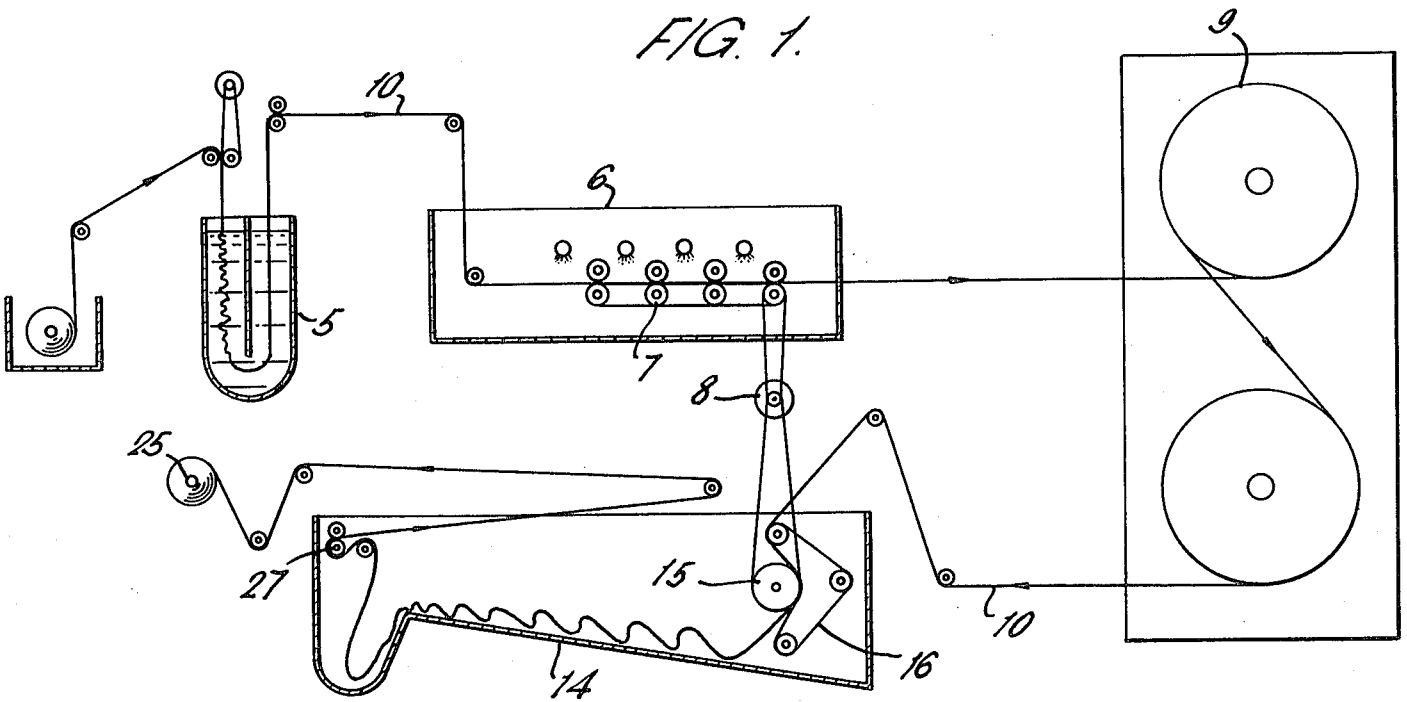
FIG. 1 is a diagrammatic representation, by way of example, of a washing machine for washing the towels used in continuous feed towel cabinets.
Figures 2, 3, 4:
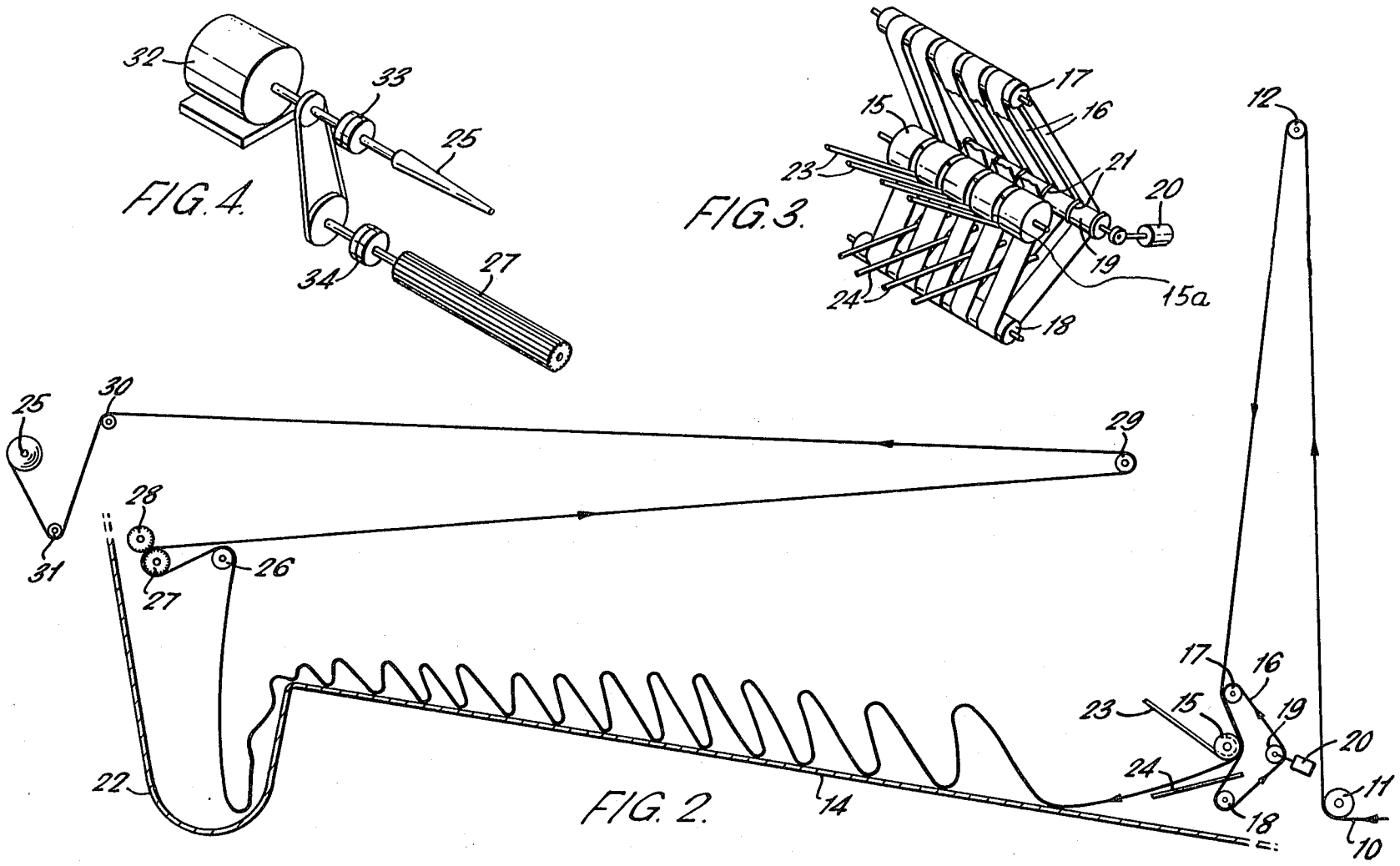
FIG. 2 is an elevation of the accumulator device of the washing machine of FIG. 1.
FIG. 3 is a perspective view of the drive means for feeding towels into the channel of the accumulator device.
FIG. 4 is a perspective view of the drive means for the rewind mandrel and the driven roller at the outlet end of the accumulator device.

For the sake of completeness, FIG. 1 shows a complete washing machine, in diagrammatic form only, for washing the towels used in continuous feed towel cabinets, the accumulator device being disposed between the drying rollers and the rewind mandrel. The accumulator device itself is shown in detail in FIGS. 2 to 4.

The towels to be washed are sewn together and fed as a continuous strip 10 into a bath 5 of detergent. The soaked towel 10 is fed through a washing portion 6 by drive means comprising pairs of rollers 7 driven by a motor 8, where it is spray washed and rinsed, and then around a series of steam heated drying rollers 9. The washed and dried towel is then fed in novel manner over a succession of rollers 11,12 into a channel 14 which forms the basic element of the accumulator device of this invention. The channel 14 is inclined upwardly in the direction of movement of the towel and the towel is fed into the channel at its lower end by a drive roller 15 and a series of belts 16 which pass around the roller 15 and also freely rotatable rollers 17,18,19 of which roller 19 is attached to a pneumatic cylinder 20 as a tensioning roller. The belts 16 are spaced apart along the roller 15 and thus provide surface to surface contact between the towel and the roller 15 which is found to be more beneficial compared with the line contact provided by the nip of a pair of rollers. To increase this advantage, the belts 16 are formed of strip material and, in this embodiment, the end belts extend beyond the edges of the towel and hence provide a partial direct drive to the back surface of the towel thereby reducing the power required to feed the towel into the channel.

Spacers 21 are provided on the tensioning roller 19 to prevent the belts moving axially of the rollers.

The drive roller 15 is also provided with circumferential grooves 15*a* for the reception of stripping fingers 23, and further stripping fingers 24 pass through the spaces between the belts 16. The stripping fingers combine to prevent the towel from wrapping itself around either roller 15 or roller 18.

The drive to the roller 15 is taken directly from the main drive motor 8 of the machine so that the peripheral speed of the roller 15 is the same as the speed of operation of the washing and drying parts of the machine which, in this embodiment, is 165 feet/minute. The towel is thus fed into the channel at a constant speed and wholly independently of a rewind mandrel 25. The channel is thus able to form a store of towel in concertina or bunched form whilst the rewind mandrel is stopped to eject a wound roll of towel and the winding of a new roll is begun. However, unlike the accumulator device described in U.S. Pat. No. 3,526,106, the channel 14 may readily store a plurality of towel lengths, e.g. seven, ten or even more towel lengths depending on its length and angle of inclination. The storage capacity of the channel is also assisted by the floor of the channel having longitudinal flutes.

At the upper end of the channel 14, the towel falls downwardly into a well 22 for the purpose of allowing the towel to straighten itself out and is then passed upwardly over roller 26 before passing through the nip of rollers 27, 28 of which roller 27 is normally driven by the towel. From the rollers 27,28 the towel is fed via rollers 29, 30, 31 to the rewind mandrel 25, the roller 31 comprising the sensing device described in British patent specification No. 1,136,454 for winding a neat roll. The extended path of the towel between rollers 27, 28 and roller 30 has been found to be necessary to allow the sensing roller 31 to operate efficiently. It also allows the operator to inspect the towel at least partially before it is wound on the mandrel 25. It will also be seen from FIG. 1 that the towel passes from well 22 over roller 26, then around roll 27 and back above roll 26 with only a narrow gap therebetween. It is found that this feature is beneficial to prevent any kinks in the towel which may be remaining after the towel is lifted from the well 22 from passing around the roller 26.

A constant torque motor 32 is provided to drive the rewind mandrel 25 via a slipping clutch 33 to allow for the continuously increasing radius of the roll being wound, and the consequent gradual increase in the take-up speed of the roll. As stated above, it has been found that the sensing device provided for controlling the rewinding of the towel to form an acceptable roll can only operate satisfactorily at a towel speed which is less than 400 feet/minute. It is thus important that the take-up speed is not allowed to exceed this predetermined maximum of 400 feet/minute. To this end, the roller 27 is connected to the drive for the rewind mandrel 25 and is provided with a clutch bearing or a ratchet mechanism 34, such as well known one-way roller bearing Model No. RC-162110 made by Torrington, Inc., South Bend, Indiana, constructed to prevent the roller 27 from rotating at a peripheral speed greater than 400 feet/minute. With regard to the rewind mandrel 25, its initial take-up speed may conveniently be 165 feet/minute which is the operational speed of the machine. Alternatively, the initial take-up speed of the rewind mandrel may be increased to, say, 250 feet/minute so that its actual take-up speed will rise more quickly to 400 feet/minute and thereby create a drag on the roller 27 which improves the efficiency of the sensing device for the production of a neat roll.

Both rollers 27, 28 are grooved longitudinally to provide a gripping action on the towel, and the upper roller 28 is mounted so that it may be raised relative to the roller 27 to facilitate threading of the towel therebetween.

It will be appreciated that, in operation, it is intended that the drive roller 15 and the belts 16 feeding the clean, dried towel into the channel 14 should operate continuously at either the machine speed of 165 feet/minute or slightly faster to provide a little slip, and unless the channel is empty and the rewind mandrel is winding a roll, the towel fed into the channel will be stored in concertina or bunched form. In contrast, the rewind mandrel is driven intermittently and the rollers 27, 28 at the upper end of the channel normally follow the towel movement and are driven by the towel and overall act to reduce the the store of towel in the channel.

Due to the increased take-up speed of the rewind mandrel and the rollers 27, 28 compared with the roller 15, the operator is able to wind several towel lengths one after the other and, if he wishes, empty the channel. He can then take a break from operation of the rewind mandrel, the channel forming a store of the towel fed therein.

The invention is not restricted to the specific details of the embodiment described above. For example, the predetermined maximum speed of the roller 27 may be selected at a speed lower than 400 feet/minute or even at a higher speed if the winding apparatus is capable of winding acceptably at the higher speed.

Also, the brake means for the roller 27 may have a variable speed drive whereby the speed of the roller 27 may be varied by the operator, preferably during winding between its maximum speed allowed by the clutch bearing and the machine speed. For example, the operator may wish to reduce the speed of winding for a short period in order to inspect the towel or to effect manual control over its winding.

I claim:

1. An accumulator device for temporarily storing a towel used in continuous feed towel cabinets as it passes through a towel washing machine comprising:

accumulator means through which the towel is passed for storing a portion of the towel in loosely formed folds;

first drive means for feeding the towel into the accumulator means at a predetermined input speed;

second drive means independent of said first drive means for removing the towel from the accumulator means at a variable speed greater than the predetermined input speed, said variable speed continuously increasing with the amount of towel removed from said accumulator means; and means for limiting the speed of said second drive means to prevent the towel from being withdrawn from the accumulator means at a speed faster than a predetermined maximum output speed.

2. A device as claimed in claim 1, wherein the means for limiting the speed of said second drive means comprises a roller over which the towel passes, and a brake mechanism attached to the roller to preclude the roller from rotating at a speed which will permit the towel to be withdrawn from the accumulator means at a speed which is greater than the predetermined maximum output speed.

3. A device as claimed in claim 2, wherein the brake mechanism is a clutch bearing.

4. A device as claimed in claim 1, wherein the limiting means comprises braking means for limiting the roller speed to maintain the predetermined maximum output speed of the towel which may be fed out of the accumulator means at 400 feet/minute.

5. A device as claimed in claim 2, wherein the brake mechanism includes means having a variable speed drive for changing the predetermined maximum output speed of the towel.

6. The device as claimed in claim 1 wherein the accumulator means comprises a storage channel having cross section dimensions sufficient to store said portion of the towel in a plurality of loosely formed folds or bunches.

7. A device as claimed in claim 6, wherein the storage channel is inclined upwardly in the direction of movement of the towel and wherein the first drive means for feeding the towel into the channel is disposed at the lower end of the channel.

8. A device as claimed in claim 6, wherein the accumulator further comprises a well adjacent the outlet end of the storage channel, the towel being fed into the well prior to being discharged from the accumulator means.

9. A washing machine for washing the towels used in continuous feed towel cabinets, the washing machine having an accumulator device as claimed in claim 1 for the storage of the clean, dry towel and for winding the towel on a rewind mandrel.

10. An accumulator device for temporarily storing a towel used in continuous feed towel cabinets as it passes through a towel washing machine comprising:

a channel through which the towel is passed, said channel having cross section dimensions sufficient to store said towel in loosely formed folds or bunches;

first drive means for continuously feeding the towel into the channel at a fixed predetermined input speed; and second drive means for removing the towel from the channel at variable speeds, said second drive means including a constant speed motor, a take-up mandrel driven by the motor for pulling the towel from the channel and winding the towel thereon at a speed which continuously increases with the amount of towel accumulated thereon, a control roller normally driven by the towel and engaging the towel as it is pulled from the channel, braking means between said motor and said roller for preventing the roller from turning faster than a predetermined maximum speed to provide a drag on the towel as it is pulled by the mandrel, and slip clutch means between the motor and the take-up mandrel to enable the mandrel to turn at a speed slower than the motor speed as the control roller provides a drag on the towel.

11. An accumulator device for temporarily storing a towel used in continuous feed towel cabinets as it passes through a towel washing machine comprising:

accumulator means through which the towel is passed for storing a portion of the towel in loosely formed folds;

first drive means for feeding the towel into the accumulator means at a predetermined input speed;

second drive means independent of said first drive means for removing the towel from the accumulator means at a variable speed including a speed faster than the predetermined input speed; and braking means for providing a drag on the towel as it is removed from the accumulator means to maintain tension on said towel between the braking means and the second drive means and thereby improve the efficiency of the second drive means.

12. A device as claimed in claim 11, wherein the means for providing a drag comprises a roller over which the towel passes and which is normally frictionally driven by said towel, and a brake mechanism attached to the roller to provide a drag on the roller as it rotates in response to the movement of the towel.

13. A device as claimed in claim 12, wherein the brake mechanism is a clutch bearing.

* * * * *